US011149730B2

(12) United States Patent
Nakamuta et al.

(10) Patent No.: US 11,149,730 B2
(45) Date of Patent: Oct. 19, 2021

(54) VANE PUMP DRIVEN BY AN ENGINE OF AN AUTOMOBILE

(71) Applicant: TAIHO KOGYO Co., Ltd., Toyota (JP)

(72) Inventors: Ken Nakamuta, Toyota (JP); Syuhei Nishida, Okazaki (JP)

(73) Assignee: TAIHO KOGYO Co., Ltd., Toyota (JP)

( * ) Notice: Subject to any disclaimer, the term of this patent is extended or adjusted under 35 U.S.C. 154(b) by 155 days.

(21) Appl. No.: 16/445,418

(22) Filed: Jun. 19, 2019

(65) Prior Publication Data

US 2020/0018308 A1 Jan. 16, 2020

(30) Foreign Application Priority Data

Jul. 11, 2018 (JP) ..... JP2018-131288

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 2/344*** | (2006.01) |
| ***F01C 21/08*** | (2006.01) |
| ***F01C 19/06*** | (2006.01) |

(52) U.S. Cl.

CPC ..... *F04C 2/3441* (2013.01); *F01C 19/06* (2013.01); *F01C 21/0809* (2013.01); *F01C 21/0881* (2013.01); *F04C 2/344* (2013.01)

(58) Field of Classification Search

CPC .... F04C 2/344; F04C 2/3441; F04C 18/3441; F04C 29/02; F01C 21/0809; F01C 21/0881; F01C 19/06

See application file for complete search history.

(56) References Cited

U.S. PATENT DOCUMENTS 3,016,184 A * 1/1962 Hart ..... F04C 18/344 418/76
3,186,347 A * 6/1965 Eickmann ..... F01C 21/0809 418/91

(Continued)

FOREIGN PATENT DOCUMENTS

DE 3619166 A * 12/1986 ..... F01C 21/089
JP 2-181089 A 7/1990

(Continued)

OTHER PUBLICATIONS

Office Action dated Jun. 2, 2020 in corresponding Japanese Patent Application No. 2018-131288 (with English Translation), 10 pages.

(Continued)

*Primary Examiner* — Theresa Trieu

(74) *Attorney, Agent, or Firm* — Oblon, McClelland, Maier & Neustadt, L.L.P.

(57) ABSTRACT

A vane pump includes a housing, a rotor rotatable about a rotation axis, and a vane that rotates together with the rotor and reciprocates in a radial direction with respect to the rotor, the vane dividing a pump chamber into a plurality of working chambers. At least one of opposite end surfaces of the vane in an axial direction is a sliding surface that slidably contacts an inner surface of the housing via an oil film, and an oil reservoir portion is provided in the sliding surface in a recessed manner.

4 Claims, 9 Drawing Sheets

(56) References Cited

U.S. PATENT DOCUMENTS

| | | | | |
|---|---|---|---|---|
| 8,480,386 | B2 * | 7/2013 | Schneider | F04C 2230/91 418/178 |
| 2008/0159896 | A1 * | 7/2008 | Kishi | F01C 21/0881 418/255 |

FOREIGN PATENT DOCUMENTS

| | | | |
|---|---|---|---|
| JP | 10-103268 | A | 4/1998 |
| JP | 11-37072 | A | 2/1999 |
| JP | 2003-343462 | A | 12/2003 |
| JP | 2004-11421 | | 1/2004 |
| JP | 2010-112333 | A | 5/2010 |
| JP | 2015-63947 | | 4/2015 |
| WO | WO 2006/005380 | A1 | 1/2006 |

OTHER PUBLICATIONS

Office Action dated Mar. 3, 2020 in corresponding Japanese Patent Application No. 2018-131288 (with English Translation), 10 pages.
Decision of Refusal dated Sep. 8, 2020 in Japanese Patent Application No. 2018-131288 (with English translation), 10 pages.
Decision of Dismissal of Amendment dated Sep. 8, 2020 in Japanese Patent Application No. 2018-131288 (with English translation), 10 pages.

* cited by examiner

VANE PUMP DRIVEN BY AN ENGINE OF AN AUTOMOBILE

INCORPORATION BY REFERENCE

The disclosure of Japanese Patent Application No. 2018-131288 filed on Jul. 11, 2018 including the specification, drawings and abstract is incorporated herein by reference in its entirety.

BACKGROUND OF THE INVENTION

1. Field of the Invention

The present invention relates to a vane pump driven by an engine of an automobile, for example.

2. Description of the Related Art

A vane pump includes a housing, a rotor, and a vane. A pump chamber is defined inside the housing. The vane rotates about a rotational axis of the rotor. The vane is disposed in the pump chamber. The pump chamber is divided into a plurality of working chambers by the vane. The volumes of the working chambers increase and decrease along with rotation of the vane. Therefore, the pressures in the working chambers also change. When there is a pressure difference between a pair of adjoining working chambers with the vane interposed therebetween, air may leak from the working chamber on the high pressure side to the working chamber on the low pressure side through a gap between the inner surface of the housing and the vane.

In this respect, a vane of a vane pump according to Japanese Patent Application Publication No. 2015-63947 (JP 2015-63947 A) includes a first vane portion and a second vane portion. A spring is interposed between the first vane portion and the second vane portion. The spring urges the first vane portion and the second vane portion away from each other.

Due to the urging force, the first vane portion and the second vane portion are pressed against the inner surface of the housing. Therefore, the gap between the inner surface of the housing and the vane can be kept small. Therefore, it is possible to suppress leakage of air from the working chamber on the high pressure side to the working chamber on the low pressure side. That is, the sealing properties of the working chambers can be secured.

SUMMARY OF THE INVENTION

However, according to the vane pump of JP 2015-63947 A, the urging force of the spring presses the vane against the inner surface of the housing. Therefore, sliding resistance during rotation of the vane tends to be large. It is therefore an object of the present invention to provide a vane pump that allows the sliding resistance during rotation of the vane to be reduced and allows the sealing properties of the working chambers to be secured.

In order to solve the above problem, a vane pump according to the present invention includes: a housing with a pump chamber; a rotor rotatable about its own axis; and a vane that rotates together with the rotor and reciprocates in a radial direction with respect to the rotor, the vane dividing the pump chamber into a plurality of working chambers. In the vane pump, at least one of opposite end surfaces of the vane in an axial direction is a sliding surface that slidably contacts an inner surface of the housing via an oil film, and an oil reservoir portion that stores lubricating oil is provided in the sliding surface in a recessed manner.

The oil reservoir portion is provided in a recessed manner in the sliding surface of the vane of the vane pump according to the present invention (more specifically, the sliding surface of the vane, which defines a gap between the vane and the inner surface of the housing). The oil reservoir portion can store lubricating oil. Therefore, it is possible to supply lubricating oil from the oil reservoir portion to the sliding surface. Thus, the sliding resistance during rotation of the vane can be reduced. Further, since the lubricating oil can be supplied from the oil reservoir portion to the sliding surface, it is possible to stably form an oil film on the sliding surface. Therefore, it is possible to secure the sealing properties of the working chambers.

MODES FOR CARRYING OUT THE INVENTION

Figure 1:
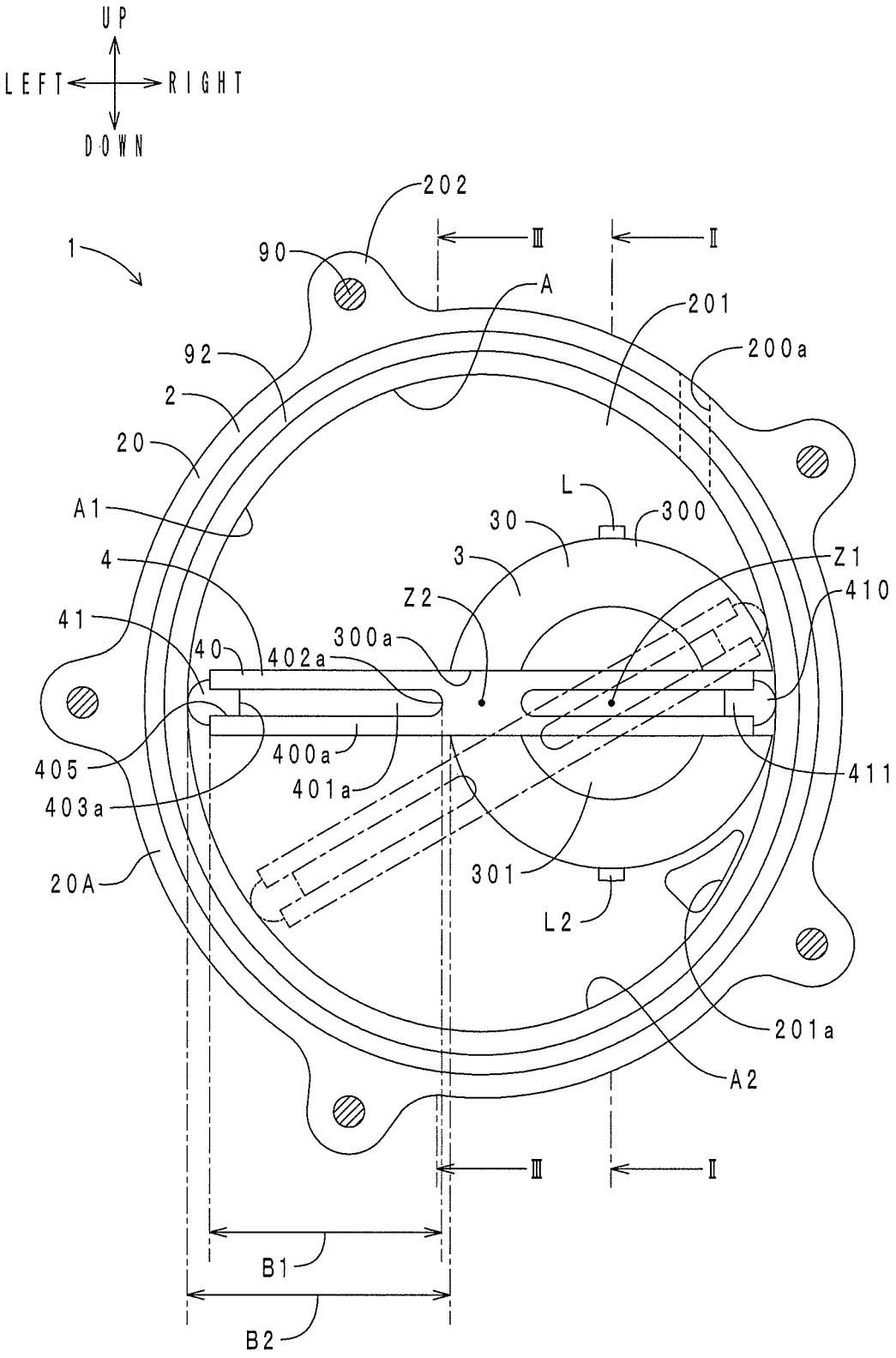
FIG. 1 is a sectional view of a vane pump according to an embodiment of the present invention, taken along a radial direction.
Figure 2:
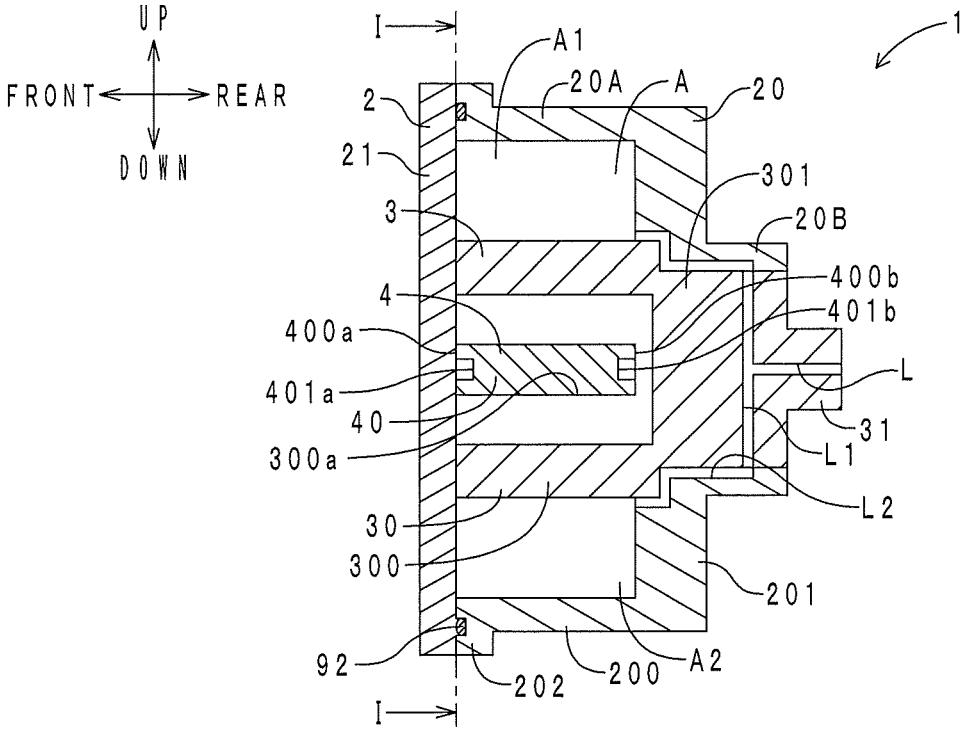
FIG. 2 is a sectional view taken along line II-II in FIG. 1.
Figure 3:
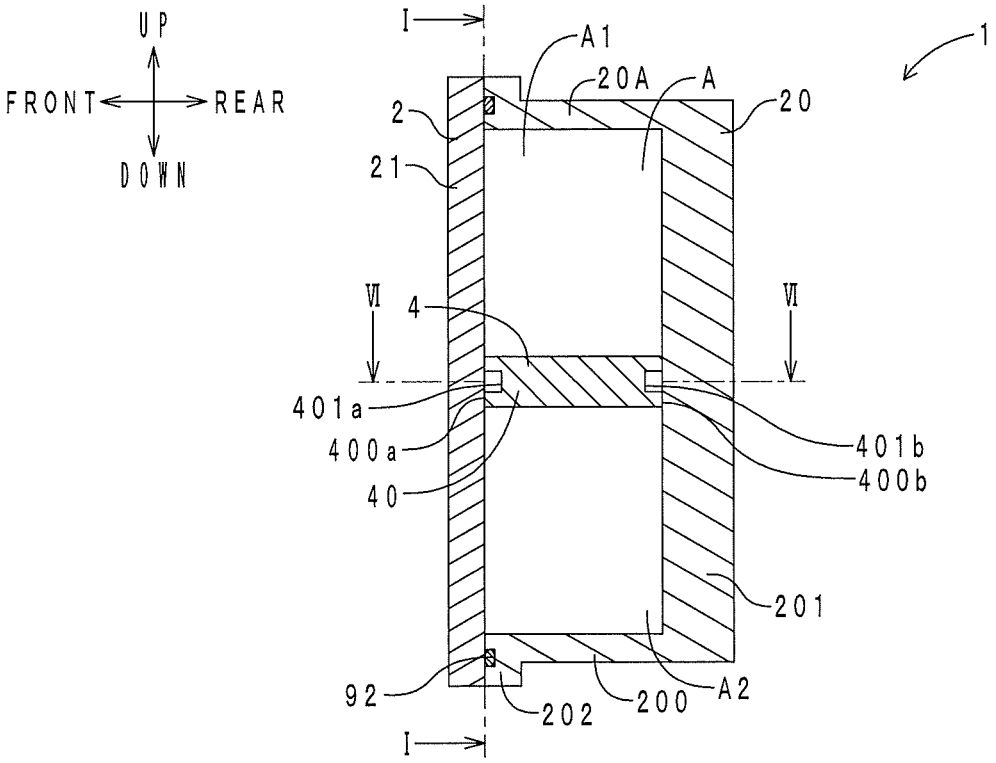
FIG. 3 is a sectional view taken along line III-III in FIG. 1.

Hereinafter, an embodiment of the present invention will be described. In the figures, a front-rear direction in which a rotational axis of a rotor extends corresponds to an "axial direction" according to the present invention. A radial direction (a longitudinal direction of a vane) around the rotational axis of the rotor corresponds to a "radial direction" according to the present invention. FIG. 1 is a sectional view of a vane pump according to the present embodiment, taken along the radial direction. FIG. 2 is a sectional view taken along line II-II in FIG. 1. FIG. 3 is a sectional view taken along the line III-III in FIG. 1. Note that FIG. 1 corresponds to a sectional view taken along line I-I in FIGS. 2 and 3.

(Configuration of Vane Pump)

First, the configuration of the vane pump according to the present embodiment will be described. A vane pump 1 is a negative pressure source for a power boosting device (not illustrated) for a brake device of a vehicle. As shown in FIGS. 1 to 3, the vane pump 1 has a housing 2, a rotor 3, a vane 4, and an oil passage L.

(Housing 2)

The housing 2 is made of metal and is fixed to a side surface of an engine (not shown). The housing 2 includes a housing body 20 and an end plate 21. The housing body 20 includes a pump portion 20A and a tubular portion 20B. The pump portion 20A has the shape of a bottomed elliptical cylinder that opens toward a front side. The pump portion 20A includes a peripheral wall portion 200, a bottom wall portion 201, and a flange portion 202. A pump chamber A is defined inside the pump portion 20A. The peripheral wall portion 200 has the shape of an elliptical cylinder. As illustrated in FIG. 1, a suction hole 200*a* is provided in the peripheral wall portion 200. An outlet of the suction hole 200*a* opens to the pump chamber A. On the other hand, an inlet of the suction hole 200*a* is coupled to the power boosting device for the brake device via a suction passage (not illustrated). A check valve (not illustrated) is disposed in the suction passage to permit air to flow in only one direction (from the power boosting device toward the pump chamber A). The bottom wall portion 201 is located at a rear end of the peripheral wall portion 200. A discharge hole 201*a* provided in the bottom wall portion 201. The discharge hole 201*a* passes through the bottom wall portion 201 in the front-rear direction. The discharge hole 201*a* can be opened/closed by a reed valve (not illustrated). As illustrated in FIG. 2, the flange portion 202 is formed at a front end of the peripheral wall portion 200.

The tubular portion 20B has the shape of a cylinder. The tubular portion 20B extends rearward of the bottom wall portion 201. The tubular portion 20B is housed in a recessed portion (not illustrated) formed in the engine. A front end of the tubular portion 20B opens to a front surface of the bottom wall portion 201.

The end plate 21 seals the flange portion 202 from the front side. An O-ring 92 is interposed between the end plate 21 and the flange portion 202. The end plate 21 is fixed to the flange portion 202 with bolts 90 and nuts (not shown).

(Rotor 3)

The rotor 3 includes a rotor body 30 and a shaft portion 31. The rotor 3 rotates in the counterclockwise direction in FIG. 1 around the rotational axis Z1 (the direction from a circumferential one end (suction hole 200*a*) to the circumferential other end (discharge hole 201*a*) in the crescent-like pump chamber A).

The rotor body 30 has the shape of a bottomed cylinder. The rotor body 30 includes a peripheral wall portion 300 and a bottom wall portion 301. The peripheral wall portion 300 has the shape of a cylinder. The peripheral wall portion 300 is housed in the pump chamber A. As illustrated in FIG. 1, a part of an outer peripheral surface of the peripheral wall portion 300 abuts against a part of an inner peripheral surface of the peripheral wall portion 200. When viewed from the front side, the peripheral wall portion 300 is eccentric with respect to the peripheral wall portion 200. As illustrated in FIG. 2, a front end surface of the peripheral wall portion 300 slidably contacts a rear surface (inner surface) of the end plate 21. As illustrated in FIG. 1, the peripheral wall portion 300 has a pair of rotor groove portions 300*a*. The pair of rotor groove portions 300*a* are disposed facing each other in the diametrical direction, that is, 180 degrees opposite each other. The pair of rotor groove portions 300*a* pass through the peripheral wall portion 300 in the diametrical direction. As illustrated in FIG. 2, the bottom wall portion 301 seals an opening of the peripheral wall portion 300 on a rear end side. The shaft portion 31 extends rearward of the bottom wall portion 301. The shaft portion 31 is coupled to a camshaft (not illustrated) of the engine via a coupling (not illustrated).

(Vane 4)

Figure 4:
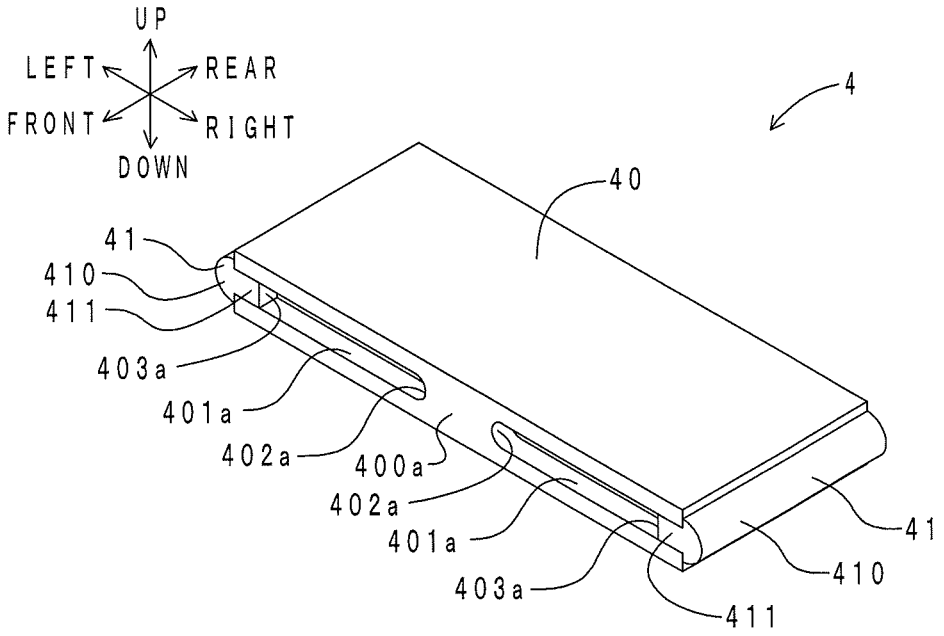
FIG. 4 is a perspective view of a vane of the vane pump.
Figure 5:
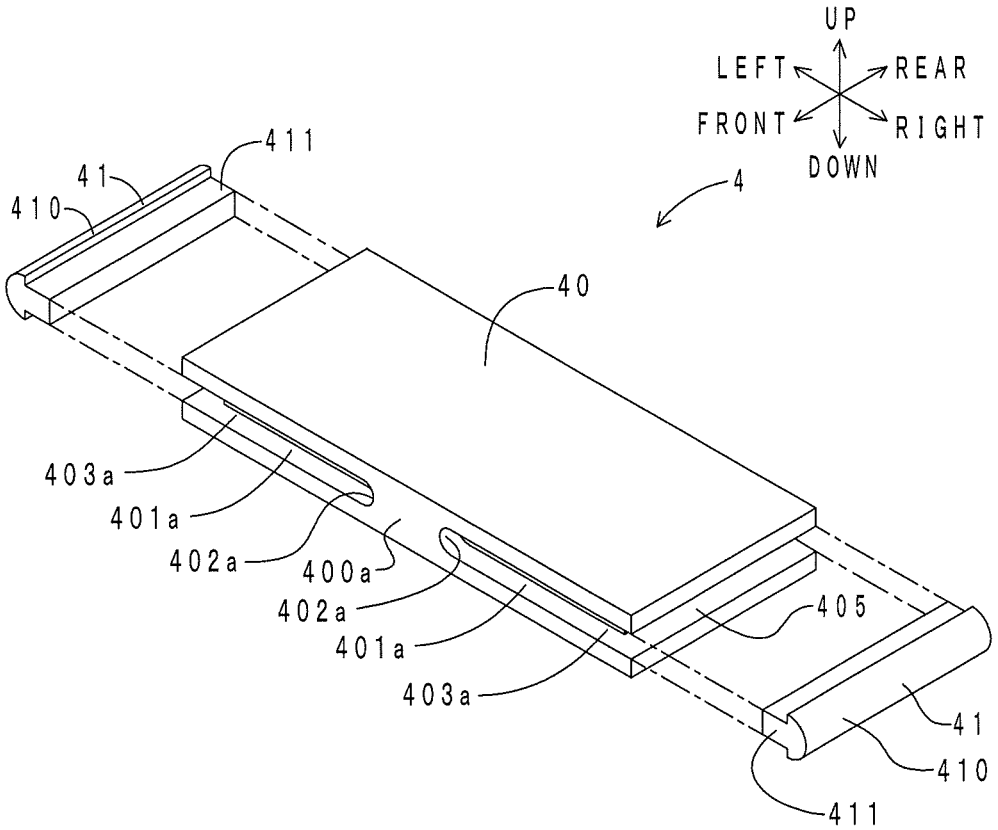
FIG. 5 is an exploded perspective view of the vane.
Figure 6:
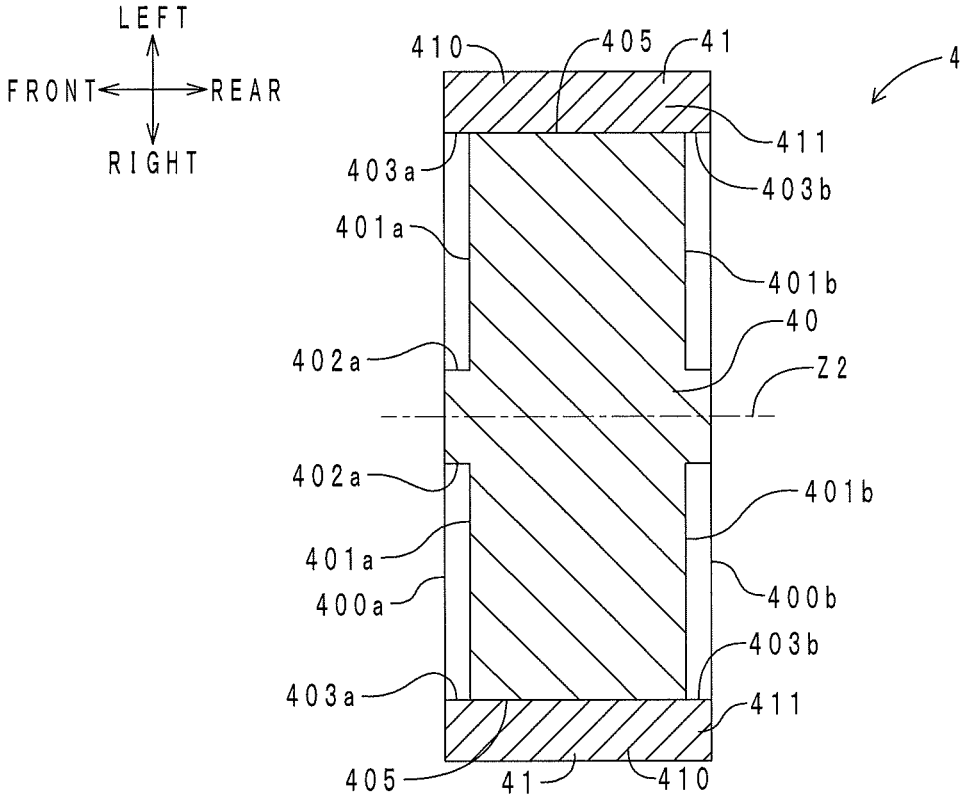
FIG. 6 is a sectional view taken along line VI-VI in FIG. 3.

FIG. 4 shows a perspective view of the vane of the vane pump according to the present embodiment. FIG. 5 shows an exploded perspective view of the vane. FIG. 6 shows a sectional view taken along line VI-VI in FIG. 3 (only the vane). As illustrated in FIG. 1 and FIGS. 4 to 6, the vane 4 includes a vane body 40 and a pair of caps 41. The vane 4 can divide the pump chamber A into a plurality of working chambers A1 and A2 in accordance with the rotational angle. The vane body 40 is made from resin and has a rectangular plate shape. The vane body 40 is housed in the pump chamber A. The vane body 40 is rotatable together with the rotor 3. The vane body 40 is capable of reciprocating in the diametrical direction (linearly movable) along the pair of rotor groove portions 300*a*.

As illustrated in FIG. 3, a sliding surface 400*a* is disposed on a front end surface (one end surface in the axial direction) of the vane body 40. The sliding surface 400*a* slidably contacts the rear surface of the end plate 21 (an inner surface of the housing 2) via an oil film. A pair of oil grooves 401*a* are provided at the center of the sliding surface 400*a* in the circumferential direction (the circumferential direction around the rotational axis Z1 shown in FIG. 1 and the direction of the plate width of the vane 4). As illustrated in FIG. 1 and FIG. 6, the pair of oil grooves 401*a* are arranged on opposite sides of the longitudinal central axis Z2 of the vane 4 so as to be separated from each other. The oil grooves 401*a* extend in the radial direction (the radial direction centering on the rotational axis Z1 shown in FIG. 1 and the longitudinal direction of the vane 4). Radially inner ends 402*a* of the oil grooves 401*a* are closed. The radially outer ends 403*a* of the oil grooves 401*a* are sealed by the caps 41 described later. Thus, each of the oil grooves 401*a* forms a closed space as viewed from the front side. As illustrated in FIG. 3, the sectional shape (shape viewed in the direction orthogonal to the longitudinal direction of the vane 4) of the oil groove 401*a* is a rectangular shape opening to the front side. As illustrated in FIG. 1 and FIG. 3, the sliding surface 400*a* (specifically, a portion of the sliding surface 400*a*, in which the oil grooves 401*a* are not provided) is provided on both sides of the oil grooves 401*a* in the circumferential direction. That is, the sliding surface 400*a* is interposed between the oil grooves 401*a* and the working chambers A1 and A2. Therefore, the oil grooves 401*a* do not open to working chambers A1 and A2.

As illustrated in FIG. 3, a sliding surface 400*b* is disposed on a rear end surface (the other end surface in the axial direction) of the vane body 40. The sliding surface 400*b* is slidably contacts the front surface of the bottom wall portion 201 (the inner surface of the housing 2) via the oil film. A pair of oil grooves 401*b* are provided at the center of the sliding surface 400*b* in the circumferential direction. As illustrated in FIG. 6, the arrangement and shape of the oil grooves 401*b* are the same as the arrangement and shape of the oil grooves 401*a*. As illustrated FIG. 5 and FIG. 6, vane grooves 405 extending in the front-rear direction are provided in the opposite end surfaces of the vane body 40 in the radial direction.

As illustrated in FIGS. 4 to 6, the caps 41 are made from resin and have a rod-like shape so as to extend in the front-rear direction. Each of the caps 41 includes a cap body 410 and a rib 411. The cap body 410 has a semi-cylindrical shape. As illustrated in FIG. 1, the cap body 410 slidably contacts the inner peripheral surface of the peripheral wall portion 200. The rib 411 is located radially inward of the cap body 410 so as to be continuous with the cap body 410. The rib 411 has a prismatic shape. The rib 411 is accommodated in the vane groove 405. As illustrated in FIG. 1 and FIG. 6, the ribs 411 seal radially outer ends 403*a* and 403*b* of the oil grooves 401*a* and 401*b* from the radially outer side. The ribs 411, namely, the caps 41 can project radially outward from the vane grooves 405 with a centrifugal force during rotation of the vane 4.

(Oil Passage L)

As illustrated in FIG. 1 and FIG. 2, the oil passage L includes a first section (oil hole) L1 and a pair of second sections (oil grooves) L2 from an upstream side toward a downstream side. The first section L1 is disposed in the shaft portion 31. The first section L1 has a T shape. The upstream end of the first section L1 opens at a rear surface of the shaft portion 31. The upstream end of the first section L1 is in communication with the oil passage (engine side oil passage) of the camshaft (not shown) via an oil joint (not shown). A pair of downstream ends of the first section L1 are arranged 180 degrees opposite each other. The pair of downstream ends of the first section L1 each open at the outer peripheral surface of the shaft portion 31.

The second sections L2 are arranged 180 degrees opposite each other. The second sections L2 are recessed in the inner peripheral surface of the tubular portion 20B. Upstream ends of the second sections L2 can communicate with the downstream ends of the first section L1 depending on a rotation angle of the rotor 3. The downstream ends of the second sections L2 open to the pump chamber A.

As illustrated in FIG. 2, lubricating oil is supplied from the camshaft to the pump chamber A via the first section L1 and the second sections L2. The first section L1 and the second sections L2 communicate with each other at every predetermined rotation angle (180 degrees). For this reason, lubricating oil is intermittently supplied from the camshaft to the pump chamber A at predetermined rotation angles.

(Operation of Vane Pump)

Next, operation of the vane pump according to the present embodiment will be described briefly. As illustrated in FIG. 2, the oil passage L is opened at a predetermined rotation angle when the vane pump 1 is driven (during rotation of the vane 4). The volumes of the working chambers A1 and A2 illustrated in FIG. 1 varies to increase and decrease along with rotation of the vane 4. As the volumes vary, the working chambers A1 and A2 suction air from the power boosting device via the suction hole 200*a*. The suctioned air is discharged to the outside from the working chambers A1 and A2 via the discharge hole 201*a*.

As described above, the lubricating oil is supplied from the camshaft to the pump chamber A via the first section L1 and the second sections L2. The lubricating oil forms an oil film on the pair of sliding surfaces 400*a* and 400*b* shown in FIG. 3. The lubricating oil is stored in the pair of oil grooves 401*a* and the pair of oil grooves 401*b*.

(Function and Effect)

Next, the function and effect of the vane pump according to the present embodiment will be described. For example, when the vane 4 shown in FIG. 1 is rotated from a position indicated by solid lines to a position indicated by alternate long and short dash lines, the volume of the working chamber A2 decreases and the volume of the working chamber A1 increases. This makes the pressure inside the working chamber A2 high and the pressure inside the working chamber A1 low. Therefore, air easily leaks from the working chamber A2 to the working chamber A1 via the sliding surfaces 400*a* and 400*b* shown in FIG. 3.

As illustrated in FIG. 1 and FIG. 3, the oil grooves 401*a* and 401*b* are provided in the sliding surfaces 400*a* and 400*b* (specifically, the sliding surfaces 400*a* and 400*b* of the vane 4 that define gaps (not shown) between the vane 4 and the inner surfaces of the housing 2). The oil grooves 401*a* and 401*b* can store lubricating oil. Therefore, an oil film can be stably formed on the sliding surfaces 400*a* and 400*b*. Therefore, air can be suppressed from leaking from the working chamber A2 to the working chamber A1 via the sliding surfaces 400*a* and 400*b* shown in FIG. 3. That is, the sealing properties of the working chambers A1 and A2 can be secured. In addition, since lubricating oil can be supplied from the oil grooves 401*a* and 401*b* to the sliding surfaces 400*a* and 400*b*, the sliding resistance during rotation of the vane 4 can be reduced.

Moreover, the oil grooves 401*a* and 401*b* can store lubricating oil. Therefore, lubricating oil can be stably supplied to the sliding surfaces 400*a* and 400*b*, even when the supply of lubricating oil to the sliding surfaces 400*a* and 400*b* is unstable (for example, when the amount of lubricating oil supplied from the oil passage of the camshaft (oil passage on the engine side) to the vane pump 1 is not constant, or when the engine has just been started (when the amount of lubricating oil supplied from the oil passage on the engine side to the vane pump 1 is 0), etc.). Thus, the oil grooves 401*a* and 401*b* function as a buffer tank for lubricating oil. Accordingly, it is possible to suppress variations in the amount of lubricating oil supplied.

As illustrated in FIG. 1 and FIG. 3, the oil grooves 401*a* are sandwiched by the sliding surface 400*a* (specifically, the portion of the sliding surface 400*a*, in which the oil grooves 401*a* are not provided) from both sides in the circumferential direction. Similarly, the oil grooves 401*b* are sandwiched by the sliding surface 400*b* (specifically, a portion of the sliding surface 400*b*, in which the oil grooves 401*b* are not provided) from both sides in the circumferential direction. Thus, the oil grooves 401*a* and 401*b* are not opened to the working chambers A1 and A2. Therefore, leakage of the lubricating oil from the oil grooves 401*a* and 401*b* to the working chambers A1 and A2 can be suppressed. In addition, as illustrated in FIG. 1, an entire radial length B1 of each of the oil groove 401*a*, 401*b*, including the portion of the oil grooves 401*a* and 401*b* sealed by the caps 41, substantially matches the maximum radial width B2 of the pump chamber A. Therefore, it is possible to secure the sealing properties of the working chambers A1 and A2.

As illustrated in FIG. 1 and FIG. 3, the oil grooves 401*a* and 401*b* extend in the radial direction. Therefore, it is possible to suppress communication between the working chambers A1 and A2 adjacent to each other in the circumferential direction with the vane 4 interposed therebetween. The oil grooves 401*a* and 401*b* are disposed adjacent to the sliding surfaces 400*a* and 400*b*. Therefore, lubricating oil can be quickly supplied from the oil grooves 401*a* and 401*b* to the sliding surfaces 400*a* and 400*b*.

As illustrated in FIG. 6, the sliding surfaces 400*a* and 400*b* have the same shape, including the arrangement, shape, and the like of the oil grooves 401*a* and 401*b*. Therefore, the vane 4 has no mounting direction with respect to the rotor 3. For example, the vane 4 may be assembled to the rotor 3 such that the sliding surface 400*b* is disposed on the front side and the sliding surface 400*a* is disposed on the rear side. Thus, the vane 4 is easy to assemble to the rotor 3.

As illustrated in FIG. 6, the caps 41 seal the radially outer ends 403*a* and 403*b* of the oil grooves 401*a* and 401*b*. Therefore, it is possible to suppress leakage of lubricating oil from the oil grooves 401*a* and 401*b* due to the centrifugal force during rotation of the vane 4.

The vane 4 is made from resin. On the other hand, the housing 2 is made of metal. Therefore, the linear expansion coefficients of the vane 4 and the housing 2 differ greatly. Thus, in order to suppress excessive pressure welding at high temperature, large clearances are secured between the vane 4 and the inner surface of the housing 2 (specifically, between the sliding surface 400*a* and the rear surface of the end plate 21 and between the sliding surface 400*b* and the front surface of the bottom wall portion 201, shown in FIG. 3). Therefore, when the vane 4 is made from resin and the housing 2 is made of metal, it is essentially difficult to ensure the sealing properties of the working chambers A1 and A2.

With the vane pump 1 according to the present embodiment, the oil grooves 401*a* and 401*b* are provided in the sliding surfaces 400*a* and 400*b*. Therefore, even if the vane 4 is made from resin and the housing 2 is made of metal, the sealing properties of the working chambers A1 and A2 can be secured.

Further, with the vane pump 1 according to the present embodiment, the sealing properties of the working chambers A1 and A2 can be secured by the oil groove 401*a* and 401*b*. Therefore, processing (for example, polishing etc.) on the sliding surfaces 400*a* and 400*b* to improve the sealing properties is unnecessary (processing may of course be provided, which further improves the sealing properties). Therefore, the manufacturing cost of the vane 4 can be reduced. Further, as illustrated in FIG. 2, both the oil grooves 401*a* and 401*b* have a bottom. The oil grooves 401*a* and the oil grooves 401*b* do not communicate with each other in the front-rear direction. Therefore, space (volume) for storing the lubricating oil is small compared to the case in which the oil groove 401*a* and the oil groove 401*b* communicate with each other in the front-rear direction (e.g., when the vane 4 has a hollow shape). Thus, the lubricating oil is likely to flow out from the oil grooves 401*a* and 401*b*. As a result, the lubricating oil can be quickly supplied from the oil grooves 401*a* and 401*b* to the sliding surfaces 400*a* and 400*b*. Further, the rigidity of the vane 4 can be increased as compared with the case where the oil grooves 401*a* and the oil grooves 401*b* communicate with each other in the front-rear direction.

(Others)

The embodiment of the vane pump according to the present invention has been described above. However, embodiments are not specifically limited to that described above. The present invention can be implemented with a variety of modifications and alterations that may be achieved by a person skilled in the art.

Figure 7A:
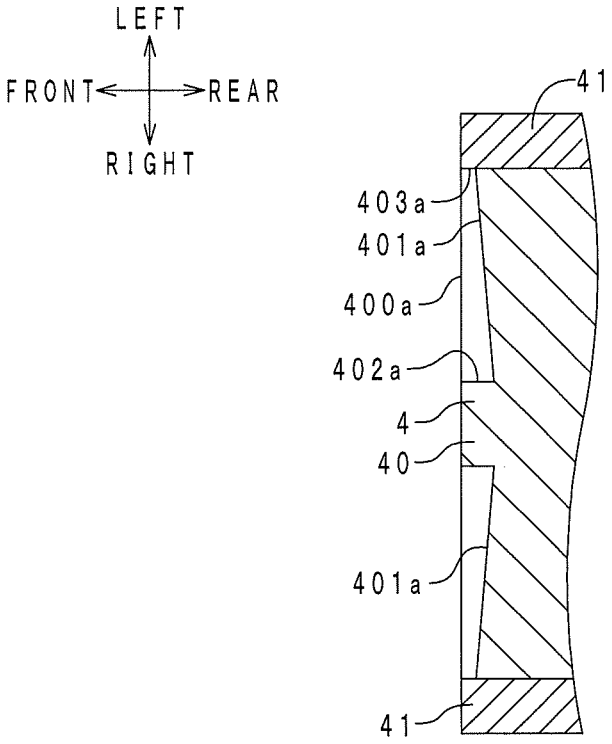
FIGS. 7A to 7C are sectional views of a front portion of the vane of the vane pump according to other embodiments (1 to 3).
Figure 7B:
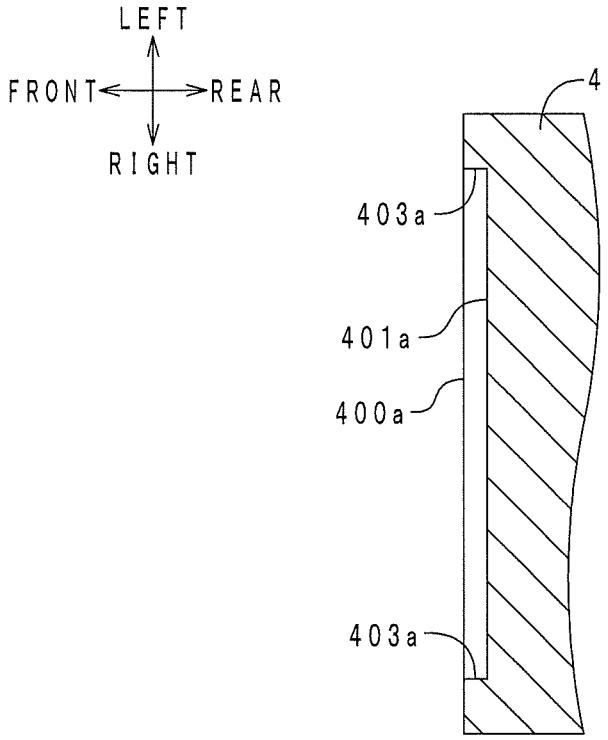
Figure 7C:
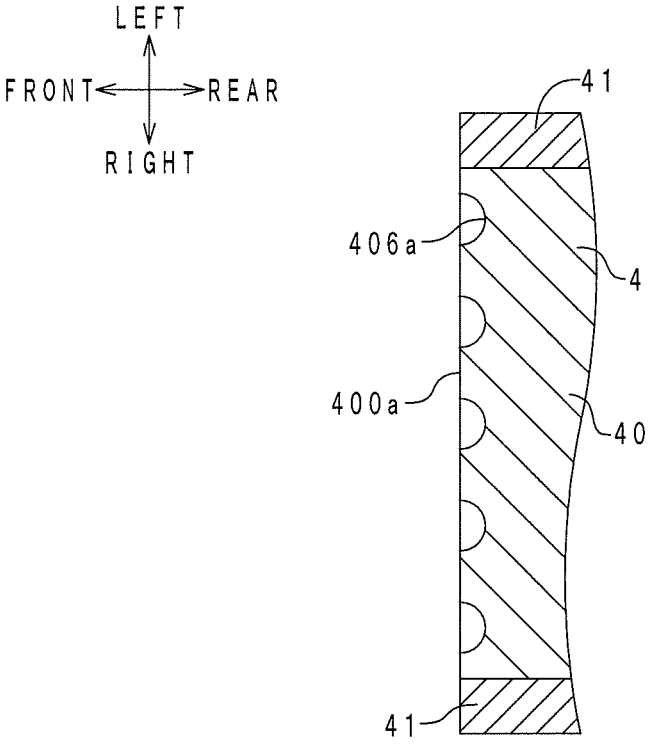

FIGS. 7A to 7C are sectional views of a front part of the vane of the vane pump according to other embodiments (1 to 3). Portions corresponding to those in FIG. 6 are denoted by the same reference symbols. As illustrated in FIG. 7, a depth of the radially outer end 403*a* of each oil groove 401*a* may be smaller than a depth of the radially inner end 402*a*. That is, the depth of the oil grooves 401*a* may be set so as to decrease from the inner side toward the outer side in the radial direction. This makes the cross-sectional area of the radially outer end 403 a of the oil groove 401*a* smaller than the cross-sectional area of the radially inner end 402*a*. Thus, it is possible to suppress leakage of lubricating oil from the oil grooves 401*a* due to the centrifugal force during rotation of the vane 4. A circumferential width of the radially outer end 403*a* of the oil groove 401*a* may be smaller than a circumferential width of the radially inner end 402*a*. Even in this case, the cross-sectional area of the radially outer end 403*a* of the oil groove 401*a* can be made smaller than the cross-sectional area of the radially inner end 402*a*.

As illustrated in FIG. 7B, the oil groove 401*a* may be disposed over the entire length of the sliding surface 400*a* (namely, the vane 4) in the radial direction. This makes it possible to secure sealing properties of the working chambers A1 and A2 over the entire length of the sliding surface 400*a* in the radial direction. Alternatively, the vane 4 may be a single piece. That is, the vane body 40 and the caps 41 shown in FIG. 4 and FIG. 5 may be integrated.

As illustrated in FIG. 7C, a plurality of oil reservoir portions 406*a* may be provided instead of the oil grooves 401*a* (or together with oil grooves 401*a*). Each of the oil reservoir portions 406*a* forms a closed space as viewed from the front side. The oil reservoir portions 406*a* do not communicate with the working chambers A1 and A2. The oil reservoir portions 406*a* are arranged over the entire length of the sliding surface 400*a* in the radial direction. Even in this case, the sealing properties of the working chambers A1 and A2 can be secured over the entire length of the sliding surface 400*a* in the radial direction. The volume of the oil reservoir portion 406*a* on the radially outer side may be smaller than the volume of the oil reservoir portion 406*a* on the radially inner side. This makes it possible to suppress leakage of lubricating oil from the oil reservoir portions 406*a* due to the centrifugal force during rotation of the vane 4. Alternatively, the number of oil reservoir portions 406*a* arranged on radially outer side may be smaller than the number of oil reservoir portions 406*a* on the radially inner side. Even in this case, it is possible to suppress the leakage of lubricating oil from the oil reservoir portions 406*a* due to the centrifugal force during rotation of the vane 4.

The radially outer ends of the oil grooves 401*a* and 401*b* shown in FIG. 6 need not to be sealed. That is, the radially outer ends of the oil grooves 401*a* and 401*b* may be opened radially outward. A plurality of oil grooves 401*a* may be arranged side by side in the circumferential direction and a plurality of oil grooves 401*b* may be arranged side by side in the circumferential direction. The shapes (longitudinal shape, cross-sectional shape) of the oil grooves 401*a* and 401*b* are not limited. The longitudinal shape may be linear, curved, or a combination of straight and curved lines as appropriate. The cross-sectional shape may be polygonal (triangular, rectangular, pentagonal, etc.), C-shaped, U-shaped, V-shaped, semicircular, and the like. The cross-sectional shape and the cross-sectional area may be constant or may be different over the entire length of the oil grooves 401*a* and 401*b*. Of the oil grooves 401*a* and 401*b*, only the oil grooves 401*a* may be disposed in the vane 4. Similarly, only the oil grooves 401*b* may be disposed in the vane 4. The shape of the oil reservoir portions 406*a* is not particularly limited. For example, the oil reservoir portions 406*a* may have a bottomed recess shape. In addition, the oil reservoir portions 406*a* may have a circular shape (perfect circular shape, elliptical shape, etc.) or a polygonal shape (triangular shape, rectangular shape, pentagonal shape, etc.), as viewed from the surface side (front side or rear side) of the sliding surfaces 400*a* and 400*b*. The vane 4 may be made of metal. The arrangement direction of the vane pump 1 is not particularly limited. For example, the direction in which the rotational axis Z1 extends in FIG. 1 may be a horizontal direction, a vertical direction, or an oblique direction (a direction intersecting with the vertical direction and the horizontal direction).

What is claimed is:

1. A vane pump comprising:

a housing with a pump chamber;

a rotor rotatable about its own axis; and a vane that rotates together with the rotor and reciprocates in a radial direction with respect to the rotor, the vane dividing the pump chamber into a plurality of working chambers, wherein at least one of opposite end surfaces of the vane in an axial direction is a sliding surface that slidably contacts an inner surface of the housing via an oil film, an oil reservoir portion that stores lubricating oil is provided in a gap defined by the sliding surface between the vane and the inner surface of the housing, and the oil reservoir portion has a bottom, and both opposite end surfaces of the vane in the axial direction do not communicate with each other through the oil reservoir portion.

2. The vane pump according to claim 1, wherein the oil reservoir portion is not open to the working chambers.

3. The vane pump according to claim 1, wherein the oil reservoir portion extends over an entire length of the sliding surface in the radial direction.

4. The vane pump according to claim 1, wherein the oil reservoir portion is an oil groove that extends in the radial direction.

* * * * *